US008161986B2

(12) United States Patent
Alessandrelli

(10) Patent No.: US 8,161,986 B2
(45) Date of Patent: Apr. 24, 2012

(54) DISH-WASHING MACHINE

(76) Inventor: Roberto Alessandrelli, Milan (IT)

( * ) Notice: Subject to any disclaimer, the term of this patent is extended or adjusted under 35 U.S.C. 154(b) by 595 days.

(21) Appl. No.: 11/920,134

(22) PCT Filed: Mar. 28, 2006
(Under 37 CFR 1.47)

(86) PCT No.: PCT/EP2006/061093

§ 371 (c)(1),
(2), (4) Date: Jul. 7, 2009

(87) PCT Pub. No.: WO2006/120062

PCT Pub. Date: Nov. 16, 2006

(65) Prior Publication Data

US 2010/0139714 A1 Jun. 10, 2010

(30) Foreign Application Priority Data

May 10, 2005 (EP) ..... 05103890

(51) Int. Cl.
*B08B 3/10* (2006.01)

(52) U.S. Cl. ..... 134/105; 134/107

(58) Field of Classification Search ..... 134/105, 134/108; 68/19.1, 20
See application file for complete search history.

(56) References Cited

U.S. PATENT DOCUMENTS

| | | | | |
|---|---|---|---|---|
| 3,026,628 A | | 3/1962 | Berger, Sr. et al. | |
| 3,130,737 A | * | 4/1964 | Jellies | 134/57 D |
| 5,076,306 A | * | 12/1991 | Suzuki et al. | 134/95.2 |
| 5,524,358 A | * | 6/1996 | Matz | 34/275 |
| 5,875,802 A | * | 3/1999 | Favaro et al. | 134/102.3 |
| 5,881,746 A | * | 3/1999 | Buser et al. | 134/58 D |
| 2006/0236556 A1 | * | 10/2006 | Ferguson et al. | 34/73 |

FOREIGN PATENT DOCUMENTS

| | | | |
|---|---|---|---|
| DE | 40 29 958 | | 11/1991 |
| EP | 0 374 616 | | 6/1990 |
| EP | 0 521 815 | | 1/1993 |
| JP | 02-092331 | * | 4/1990 |
| JP | 07-039691 | * | 2/1996 |
| JP | 11-042197 | * | 2/1999 |
| JP | 2002-263050 | * | 9/2002 |

OTHER PUBLICATIONS

European Patent Office 0 370 875 May 1990.*
European Patent Office 0 521 815 Jan. 1993.*
European Patent Office 0 920 830 Jun. 1999.*
International Search Report mailed Sep. 15, 2006 for International Application No. PCT/EP2006/061093.
Written Opinion of the International Searching Authority mailed Sep. 15, 2006 for International Application No. PCT/EP2006/061093.

* cited by examiner

*Primary Examiner* — Frankie L Stinson
(74) *Attorney, Agent, or Firm* — Pearne & Gordon LLP

(57) ABSTRACT

Dish-washing machine comprising a chamber (2) for washing articles (3), an air inlet line and an air outlet line both communicating with the chamber, air circulating means for forcing an inlet airflow sucked from the atmosphere into the chamber (2) via said air inlet line and exhausting an outlet airflow saturated with moisture after passing over said articles (3) to the atmosphere via said air outlet line; heating means are provided for heating said outlet airflow before exhausting to the atmosphere in order to reduce the relative humidity of the discharged air.

16 Claims, 3 Drawing Sheets

DISH-WASHING MACHINE

The present invention refers to a dish-washing machine.

It is known in the art a dish-washing machine wherein a heated drying airflow for drying the articles is introduced into the washing chamber and wherein a vapour-saturated air extracted from the chamber is mixed with dry air before exhausting to the atmosphere.

U.S. Pat. No. 3,026,628 discloses a dish-washing machine of the above-mentioned kind utilizing an arrangement for conducting the air for the drying operation of the articles and for discharging the air into the atmosphere. U.S. Pat. No. 3,026,628 recognizes the disadvantage of discharging steam, or air of a high relative humidity directly into the room in which the dish-washing is placed because of the damages, which the humid air can cause to the furniture, and to the household in the room. To reduce the humidity in the total amount of discharged air and completely avoid discharging visible steam of fog into the room, an amount of dry air is mixed with the air being discharged into the room from the dishwasher. Pressurized air is supplied, for both the drying air and the mixing air, by a centrifugal type fan appropriately housed within the cabinet of the washer. The fan forces a steam of air through an Y shaped conduit whereupon the air flows along the two branches of the conduit for drying and mixing. The first branch introduces the drying air into the washing chamber for drying the articles, the drying air being heated before entering the chamber by means of a heater provided in such first branch. The second branch directs the mixing air into the chamber in correspondence to the outlet opening where the mixing air mixes with vapour-saturated air before exhausting to the atmosphere. A deflector vane controls the division of air from the fan between the branch leading the drying air and the branch leading the mixing air.

A drawbacks of this type of dish-washing machine is that in order to reduce the humidity of the air discharged to the atmosphere a considerable mixing airflow is needed, especially at the beginning of the drying cycle, with the consequence that a minimum drying airflow is thus introduced into the chamber.

Hence the drying cycle is not effective and takes a considerable length of time.

A further drawback is that the mixing between the mixing air and the vapour-saturated air before exhausting to the atmosphere is not effective so that the air discharged from the washing chamber is substantially still moisture laden.

The aim of the present invention is therefore to solve the noted problems, eliminating the drawbacks of the cited known art and thus providing a dish-washing machine with an improved drying cycle.

Still another object of this invention is to provide a dish-washing machine, which is relatively simple in construction, inexpensive to manufacture, easy to mass produce, and durable in use.

According to the present invention, these aims are reached in a dish-washing machine having the characteristics as recited and defined in the appended claims.

Anyway, features and advantages of the present invention may be more readily understood from the description that is given below by way of a non-limiting example with reference to the accompanying drawings, in which.

Figure 1:
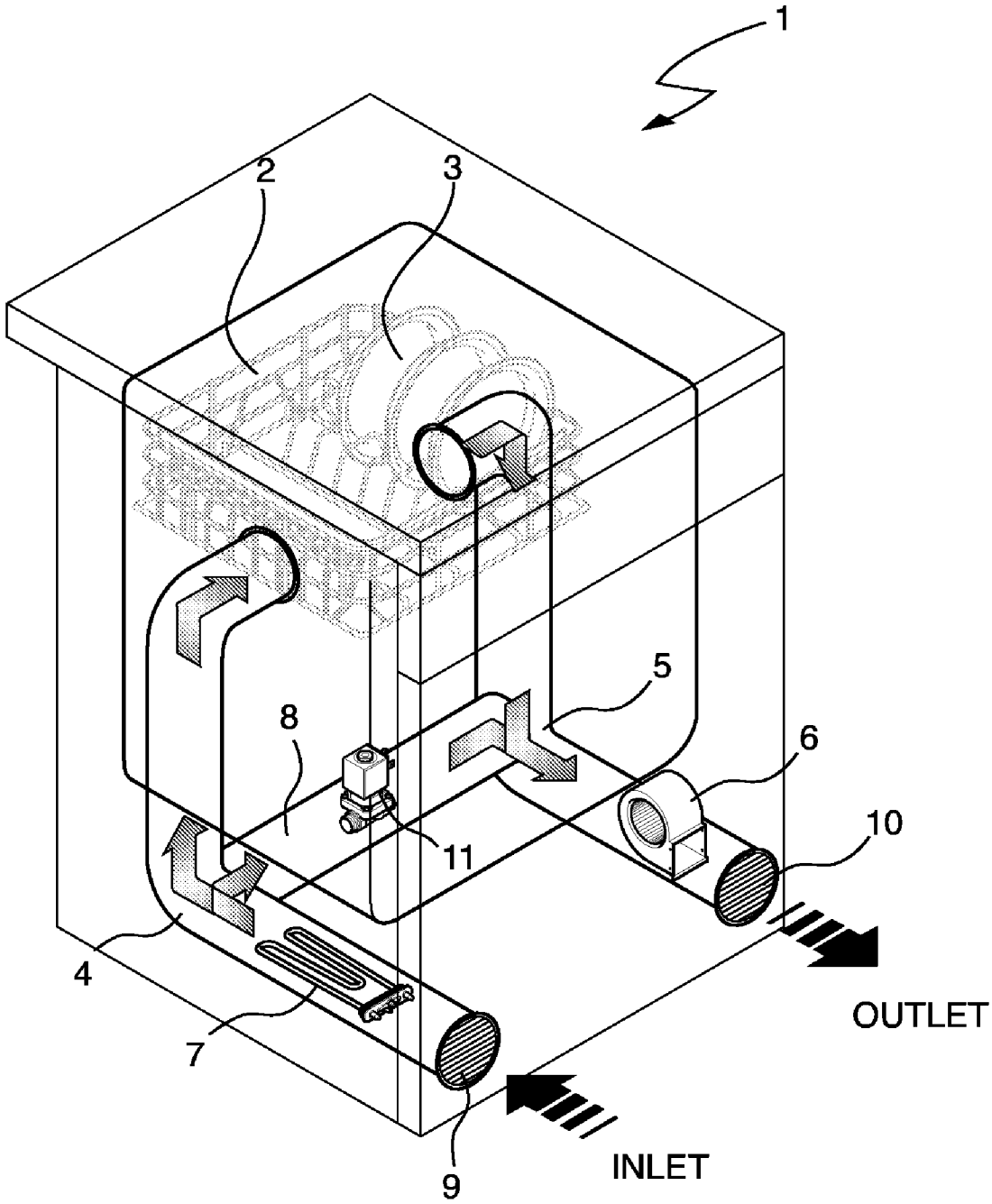
FIG. 1 is a perspective elevational view of a dish-washing machine according to the present invention.
Figure 2:
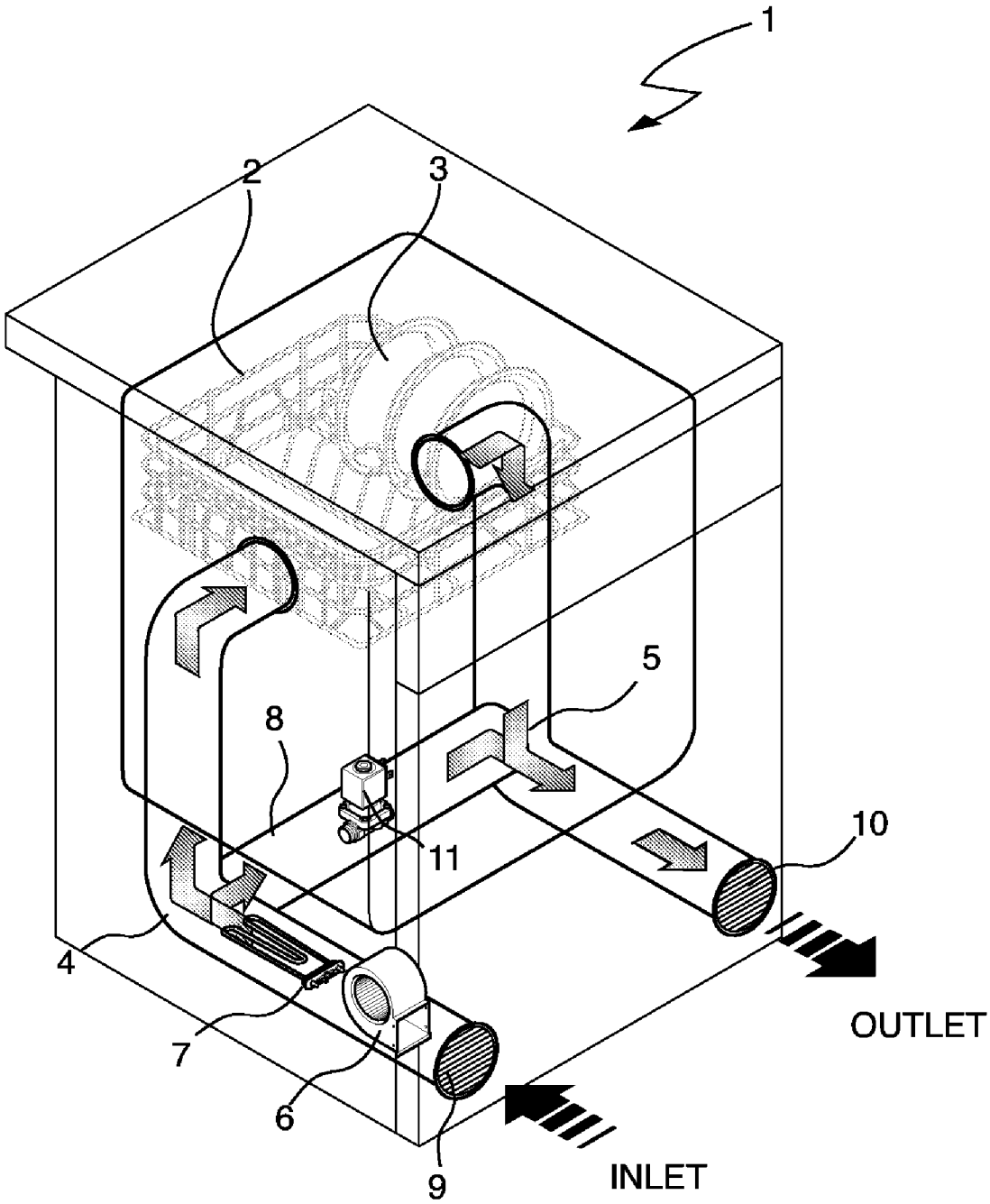
FIG. 2 is a perspective elevational view of a dish-washing machine according to a further embodiment of the present invention.

With reference to the FIGS. 1 and 2, a dish-washing machine according to the present invention, generally designated by the reference numerical 1, comprises a chamber 2 for washing articles 3, an air inlet line and an air outlet line both communicating with the chamber 2, air circulating means 6 for forcing an inlet airflow sucked from the atmosphere into the chamber 2, via said air inlet line, and exhausting an outlet airflow saturated with moisture after passing over said articles 3 from the chamber 2 to the atmosphere, via said air outlet line.

Heating means are provided for heating said outlet airflow before exhausting to the atmosphere in order to reduce the relative humidity of the discharged air.

The heating means can comprise at least a heating device arranged in correspondence to the air outlet line or at least a heated airflow adapted to mix with the outlet airflow before exhausting to the atmosphere.

In a preferred embodiment the dish-washing machine comprises means for mixing air with the airflow saturated with moisture before exhausting to the atmosphere.

The means for mixing comprise at least a bypass line 8 bypassing the chamber for directing at least a portion of the inlet airflow to the air outlet line in order to mix with the airflow saturated with moisture.

At least a heating element 7 is provided for heating said portion of the inlet airflow before mixing with the airflow saturated with moisture and for heating the inlet airflow before entering the chamber 2.

The air inlet line comprise a first air conduit 4 communicating with the chamber 2 and with the atmosphere by means of a suction aperture 9 through which the inlet airflow is taken in. The air outlet line comprise a second air conduit 5 communicating with the chamber 2 and with the atmosphere by means of a discharging aperture 10 through which the outlet airflow saturated with moisture after passing over the articles 3 is discharged to the atmosphere from the chamber 2. The bypass line 8 comprises a third air conduit connecting the first air conduit 4 and the second air conduit 5 each other.

The bypass line 8 is adapted to lead at least a first portion of the inlet airflow, defined hereinafter as mixing airflow, to the second conduit 5 of the air outlet line wherein such mixing airflow is mixed with the outlet airflow saturated with moisture flowing from the chamber 2.

The first air conduit 4 is adapted to direct the inlet airflow in correspondence to the bypass line 8 and to introduce a first portion of the inlet airflow, defined hereinafter as drying airflow, into the chamber 2.

The second air conduit 5 of the air outlet line is adapted to extract the outlet airflow saturated with moisture from the chamber 3, to receive the mixing airflow flowing through the bypass line, to mix such airflows and to direct the resulting mixed airflow to the discharging aperture 10.

The air circulating means 6 comprise a blower assembly arranged in the second air conduit 5 of the outlet line downstream the bypass line 8.

The heating element 7, which can comprise for example an electric resistor, is arranged in the first air conduit 4 of the inlet airflow upstream the bypass line 8, as shown in FIG. 1.

The dish-washing according to the present invention comprises valve means 11 adapted to adjust the amount of the mixing airflow passing through the bypass line 8 in order to control and regulate the ratio of the mixing airflow to the drying airflow passing defined hereinafter as the mixing ratio.

In a further embodiment of the present invention the blower assembly is arranged in the first air conduit 4 of the air inlet line upstream the bypass line 8, as shown in FIG. 2.

Next, the operation of the above embodiments will be described below.

The blower assembly forces the inlet airflow of ambient temperature air into the first air conduit 4 of the inlet airflow line through the suction aperture 9. The inlet airflow is then led over the electric resistor where it picks up heat. In correspondence to the third air conduit of the bypass line 8, a firs portion of the heated inlet airflow, i.e. the drying airflow, is directed towards the chamber 2 for drying the articles 3, while a second portion of the heated inlet airflow is led to the bypass line 8 through the third air conduit.

The amount of the heated inlet airflow adapted to flow along the bypass line 8, i.e. the mixing airflow, is determined by the valve means. Normally the opening of the valve means is selected in order to allow about 0-60% of the heated inlet flow to pass into the bypass line 8 depending on the phase of drying cycle.

The drying airflow flows through and around the articles 3 and evaporates moisture therefrom, thus now the outlet airflow saturated with moisture is extracted from the chamber 2 through the second air conduit 5 of the outlet airflow line, where in correspondence to the bypass line 8 it is mixed with the mixing airflow flowing along the third air conduit. The relative humidity of the resulting mixed airflow is then reduced and the latter is exhausted to the atmosphere through the discharging aperture 10.

At the beginning of the drying cycle, since the chamber 2 is very humid, the mixing ratio needs to be relative higher than during the subsequent phase of the drying cycle. Hence at the beginning the mixing airflow is about 60% of the heated inlet flow taken in through the suction aperture 9. In view of the fact that the chamber humidity progressively decreases, the opening of the valve means 11 is reduced so that in stationary condition no heated inlet airflow is directed to the bypass line to be mixed with the outlet airflow saturated with moisture.

Figure 3:
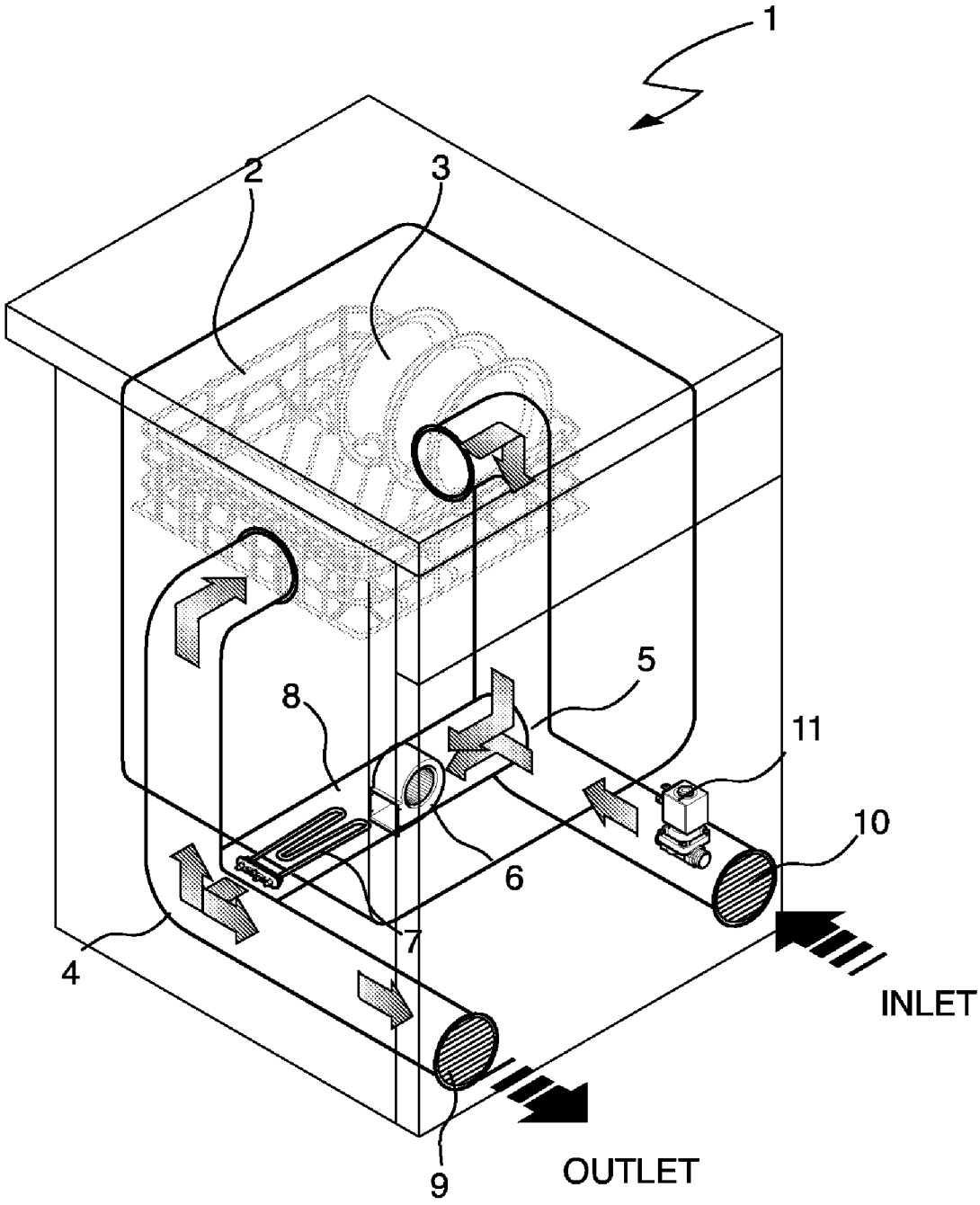
FIG. 3 is a perspective elevational view of a dish-washing machine according to a further embodiment of the present invention.

In a further preferred embodiment of the present invention, shown in FIG. 3, where the same reference number have been used for parts that correspond to those shown in FIGS. 1 and 2, a dish-washing machine comprises a chamber 2 for washing articles 3, an air inlet line and an air outlet line both communicating with the chamber 2, air circulating means 6 for forcing a drying airflow into the chamber 2, via said air inlet line, and extracting a moisture-laden airflow from said chamber 2 after passing over said articles 3, via said air outlet line, and mixing means for mixing an inlet airflow sucked from the atmosphere with the moisture-laden airflow before exhausting to the atmosphere in order to reduce the relative humidity of the discharged air.

The mixing means comprises at least a bypass line 8 bypassing the chamber 2 and communicating with said air inlet line and said air outlet line, the bypass line 8 being adapted to receive the inlet airflow and the moisture-laden airflow for mixing said inlet airflow with said moisture-laden airflow, the bypass line 8 being adapted to split the resulting mixed airflow into said drying airflow and into an outlet airflow to be exhausted into the atmosphere, heating means 7 are provided for heating the outlet airflow before exhausting to the atmosphere.

The dish-washing comprise a first air conduit 4 communicating with the chamber 2 and with the atmosphere by means of a discharging aperture 9. The first air conduit 4 is adapted to introduce a portion of the mixed airflow, i.e. the drying airflow, into the chamber 2 for drying articles 3 and to exhaust a second portion of the mixed airflow, i.e. the outlet airflow, to the atmosphere.

Further the dish-washing comprises a second air conduit 5 communicating with the chamber 2 and with the atmosphere by means of a suction aperture 10 through which the inlet airflow is directed to the bypass line 8. The second air conduit 5 is adapted to extract the moisture-laden airflow from the chamber 2, to sucks the inlet airflow from the atmosphere and further to lead such airflows to the bypass line in which they are mixed.

The bypass line 8 comprises a third air conduit connecting the first air conduit 4 and the second air conduit 5 each other.

The bypass line 8 is adapted to receive, via the second air conduit 5, the moisture-laden airflow from the chamber 2 and the inlet airflow from the atmosphere, and further it is adapted to mix such airflows and to lead the resulting mixed airflow in correspondence to the first conduit 4, where the mixed airflow is split.

The air circulating means 6 comprise a blower assembly preferably arranged in the third air conduit 8 of the bypass line 8.

The heating means 7, which can comprise for example an electric resistor, are arranged in the third air conduit of the bypass line 8 in order to heat the mixed airflow, as shown in FIG. 3.

Advantageously the dish-washing according to the present invention comprises valve means 11 adapted to adjust the amount of the inlet airflow sucked through the suction aperture 10 in order to control and regulate the ratio of the inlet airflow to the moisture-laden airflow.

Clearly the valve means 11 can be arranged in correspondence to the suction aperture 10 or to the discharging aperture 9.

Next, the operation of the above embodiment will be described below.

The blower assembly forces the inlet airflow of ambient temperature air through the suction aperture 10 and extracts moisture-laden airflow from the chamber 2. The second air conduit 5 directs such airflows to the third air conduit of the bypass line 8 where the inlet airflow and the moisture-laden airflow mix each other. The resulting mixed airflow flows along the bypass line and it passes through the heating means 7 where it picks up heat. In correspondence to the first air conduit 4, the heated mixed airflow is then split into the drying airflow and into the outlet airflow. The drying airflow is directed, via the first air conduit 4, towards the chamber 2, where it flows through and around the articles 3 and evaporates moisture therefrom, while the outlet airflow is exhausted to the atmosphere through the discharging aperture 9.

The amount of the inlet airflow adapted to flow along the bypass line 8 is determined by the valve means 11. Normally the opening of the valve means is selected so that the inlet airflow forms about 70% of the mixed airflow passing along the bypass line depending on the phase of drying cycle.

The moisture-laden airflow extracted from the chamber 2 forms the remaining part of the mixed airflow, i.e. about 30%.

It is to be noted that the drying airflow entering the chamber and the outlet airflow exhausted to the atmosphere are substantially the same.

The relative humidity of the moisture-laden airflow is reduced by mixing it with the inlet airflow inside the bypass line, then the heating means 7 further considerably reduce the relative humidity of the resulting mixed airflow, so that the outlet airflow to be exhausted is substantially dried, as well as the drying airflow entering the chamber.

At the beginning of the drying cycle, since the chamber 2 is very humid, the inlet airflow needs to be relatively higher than during the subsequent phase of the drying cycle. Hence at the beginning the inlet airflow, taken in through the suction aperture 10, is about 70% of the mixed airflow flowing along the bypass line. In view of the fact that the chamber humidity progressively decreases, the opening of the valve means 11 is reduced so that in stationary condition the inlet airflow, taken in through the suction aperture 10, forms 45-60% of the mixed airflow flowing along the bypass line.

Conclusively, it can therefore be stated that the dish-washing machine according to the present invention provides an effective and rapid drying cycle wherein the air to be discharged to the atmosphere from the washing chamber is substantially dry, thereby doing away with the serious drawback shared by prior-art machines.

The invention claimed is:

1. Dish-washing machine comprising a chamber (2) for washing articles (3), an air inlet line and an air outlet line both communicating with the chamber, air circulating means for forcing an inlet airflow sucked from the atmosphere into the chamber (2) via said air inlet line and exhausting an outlet airflow saturated with moisture after passing over said articles (3) to the atmosphere via said air outlet line, wherein heating means are provided for heating said outlet airflow before exhausting to the atmosphere in order to reduce the relative humidity of the discharged air, wherein said heating means comprise at least a heated airflow adapted to mix with outlet airflow before exhausting to the atmosphere, and wherein the dish-washing machine further comprises at least a bypass line (8) bypassing the chamber (2) adapted to direct at least a portion of the inlet airflow to the air outlet line in order to mix with the airflow saturated with moisture, at least a heating element (7) is provided for heating said portion of the inlet airflow before mixing with the airflow saturated with moisture.

2. Dish-washing machine according to claim 1, wherein said heating means comprise at least a heating device arranged in correspondence to the air outlet line.

3. Dish-washing machine according to claim 1, wherein said heating element (7) is adapted to heat the inlet airflow before entering the chamber (2).

4. Dish-washing machine according to claim 1, wherein said air inlet line comprise a first air conduit (4) communicating with the chamber (2) and with the atmosphere by means of a suction aperture (9) through which the inlet airflow is taken in, said first air conduit (4) being adapted to direct the inlet airflow in correspondence to the bypass line (8) and to introduce a second portion of the inlet airflow into the chamber (2).

5. Dish-washing machine according to claim 1, wherein said air outlet line comprise a second air conduit (5) communicating with the chamber (2) and with the atmosphere by means of a discharging aperture (10) through which the outlet airflow saturated with moisture is discharged to the atmosphere from the chamber (2), said second air conduit (5) being adapted to extract the outlet airflow saturated with moisture from the chamber (3), to receive the first portion of the inlet airflow flowing through the bypass line (8), to mix said airflows and to direct the resulting mixed airflow to the discharging aperture (10).

6. Dish-washing machine according to claim 5, wherein said air circulating means (6) comprise a blower assembly arranged in the second air conduit (5) of the outlet line downstream the bypass line (8).

7. Dish-washing machine according to claim 5, wherein said air circulating means (6) comprise a blower assembly arranged in the first air conduit (4) of the air inlet line upstream the bypass line 8.

8. Dish-washing machine according to claim 1, wherein said heating element (7) is arranged in the first air conduit (4) of the inlet airflow upstream the bypass line (8).

9. Dish-washing machine according to claim 1, wherein valve means (11) are provided for adjusting the amount of said at least a portion of the inlet airflow passing through the bypass line (8).

10. Dish-washing machine comprising a chamber (2) for washing articles (3), an air inlet line and an air outlet line both communicating with the chamber (2), air circulating means (6) for forcing a drying airflow into the chamber (2) via said air inlet line and extracting a moisture-laden airflow from said chamber (2) after passing over said articles (3) via said air outlet line and mixing means for mixing an inlet airflow sucked from the atmosphere with the moisture-laden airflow before exhausting to the atmosphere in order to reduce the relative humidity of the discharged air, wherein said mixing means comprise at least a bypass line (8) bypassing the chamber (2) and communicating with said air inlet line and said air outlet line, the bypass line (8) being adapted to receive the inlet airflow and the moisture-laden airflow for mixing said inlet airflow with said moisture-laden airflow, the bypass line (8) being adapted to split the resulting mixed airflow into said drying airflow and into an outlet airflow to be exhausted into the atmosphere, heating means (7) being provided for heating the outlet airflow before exhausting to the atmosphere.

11. Dish-washing machine according to claim 10, wherein it comprises a first air conduit (4) communicating with the chamber (2) and with the atmosphere by means of a discharging aperture (10), said first air conduit (4) being adapted to introduce the drying airflow into the chamber (2) and to exhaust the outlet airflow to the atmosphere.

12. Dish-washing machine according to claim 11, wherein said bypass line (8) comprises a third air conduit connecting the first air conduit (4) and the second air conduit (5) each other, said bypass line (8) being adapted to receive, via the second air conduit (5), the moisture-laden airflow from the chamber (2) and the inlet airflow from the atmosphere, said bypass line (8) being adapted to mix said airflows and to split the resulting mixed airflow in correspondence to the first conduit (4).

13. Dish-washing machine according to claim 12, wherein said air circulating means (6) comprise a blower assembly arranged in the third air conduit of the bypass line (8).

14. Dish-washing machine according to claim 10, further comprising a second air conduit (5) communicating with the chamber (2) and with the atmosphere by means of a suction aperture (9) through which the inlet airflow is directed to the bypass line (8), said second air conduit (5) being adapted to extract the moisture-laden airflow from the chamber (2), to sucks the inlet airflow from the atmosphere and further to lead said airflows to the bypass line (8) for mixing.

15. Dish-washing machine according to claim 10, wherein said heating means (7) are arranged in the bypass line (8) in order to heat the mixed airflow.

16. Dish-washing machine according to claim 10, wherein valve means (11) are provided for controlling and regulating the ratio of the inlet airflow to the moisture-laden airflow.

* * * * *